United States Patent [19]

Goldberg et al.

[11] Patent Number: 4,459,050

[45] Date of Patent: Jul. 10, 1984

[54] SERVO CONTROL SYSTEM FOR CARRIAGE OF MATRIX PRINTER

[75] Inventors: Edward M. Goldberg, Albany; Larry R. Herzberg, Boulder Creek, both of Calif.

[73] Assignee: Chroma, San Jose, Calif.

[21] Appl. No.: 370,331

[22] Filed: Apr. 21, 1982

[51] Int. Cl.[3] ..... B41J 3/12

[52] U.S. Cl. ..... 400/121; 400/124; 400/229; 400/322

[58] Field of Search ..... 400/121, 124, 320, 322, 400/328, 225, 229, 232, 279

[56] References Cited

U.S. PATENT DOCUMENTS 4,280,767 7/1981 Heath ..... 400/216.2

4,326,813 4/1982 Lomicka et al. ..... 400/124

OTHER PUBLICATIONS

*IBM Tech. Disc. Bulletin,* by D. W. Skinner et al., vol. 21, No. 5, Oct. 1978, pp. 1828–1829, 400–240.4.

*Primary Examiner*—Paul T. Sewell

*Attorney, Agent, or Firm*—Flehr, Hohbach, Test, Albritton & Herbert

[57] ABSTRACT

A servo control system for the carriage of a matrix impact printer allows printing to occur during both acceleration and deceleration of the carriage. This is especially useful where the carriage is transporting several ribbon cartridges of different colors. In addition, printing may occur during the midrange portion of the carriage which is driven at a variable velocity to compensate for differences in printing and resolution requirements.

3 Claims, 19 Drawing Figures

SERVO CONTROL SYSTEM FOR CARRIAGE OF MATRIX PRINTER

The present invention is directed to a servo control system for the carriage of a matrix printer and more specifically to a system which in combination with the control of the carriage velocity also controls the print head to provide for effective printing of characters or graphics.

Present impact matrix printers have a print head of several pins which are selectively actuated to form any type of character or for that matter an unusual graphic's figure. Because of the time required from the actuation of a print head wire to the time it hits the ribbon (fly time) and then the time to recover, this factor limits the speed of printing and must be taken into account in all impact matrix printers. This has been done by a speed selection system where, for example, the operator of a printer could select between 36 inches per second, 24.4 inches per second or 16 inches per second. On other printers, perhaps six different speed options were given. The operator would guess at a worse case condition of the type of material to be printed and select the speed. Or, on the other hand, the operator would sacrifice printing quality for faster speed.

Yet, another factor in impact matrix printing, is that as in all printers where a carriage carries the printing mechanism along a line of printing, it is mandatory to start printing only when the carriage is moving at a constant velocity so that the printing apparatus can be actuated at predetermined periodic time intervals. However, this has an unfortunate effect in types of printing where, for example, more than one ribbon cartridge is desired to be used; for example, for multi-color printing, thus adding to the weight of the carriage. In such a device, the acceleration and deceleration times before the desired steady state speed is reached is unfortunately longer and thus there must be provided adequate acceleration and deceleration space. This makes the machine larger, more expensive. Plus the higher acceleration area mandates more massive and expensive frames, motors, etc.

Thus, it is apparent that prior impact matrix printers in situations where more sophisticated and complicated types of printing are desired, such as, complex graphics or multi-color printing where more than one cartridge is necessary, in this more sophisticated type of printing, the capabilities of the printers are severely degraded.

It is, therefore, a general object of this invention to provide an improved matrix printer.

In accordance with the above object, there is provided a servo control system for the carriage of a matrix impact printer where the printer in addition to carrying a print head carries at least one ribbon cartridge.

This system comprises a motor controller for driving the carriage and means for sensing the actual velocity and position of the carriage. A target velocity is determined based on the recovery and fly time of the pins of the print head relative to the dots to be printed in a particular zone of a line of printing. The actual and target velocities are compared to provide an error signal which drives the motor controller for the carriage.

Another basic aspect of the invention, where the carriage may have significant weight relative to acceleration and deceleration while traversing along a line of printing and also reversing, includes, of course, a motor controller for driving the carriage through all the foregoing modes; and in addition, means for sensing the actual velocity and position of the carriage. The velocity information is used for controlling the movement of the carriage and the position information for controlling and actuating the print head during periods of acceleration and deceleration as well as during relatively steady state periods.

Figure 1:
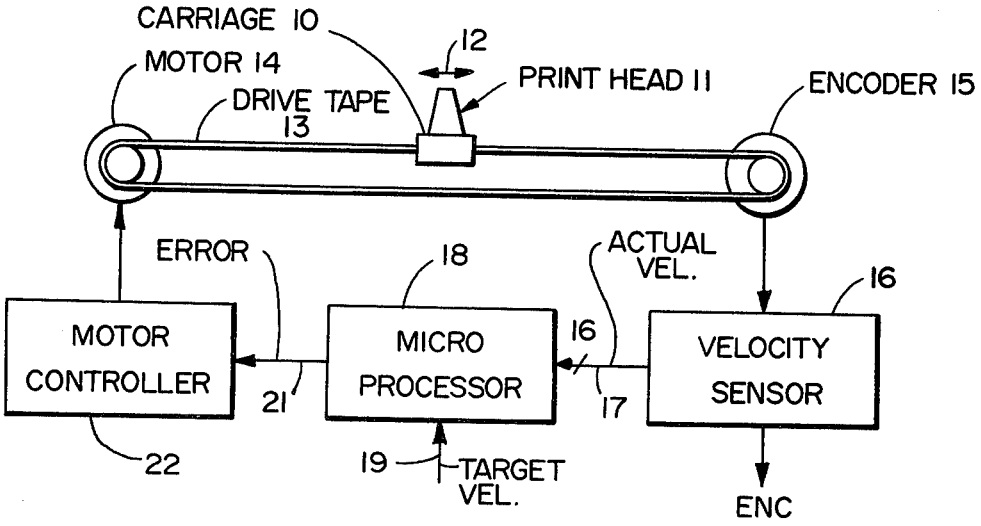
FIG. 1 is a simplified diagrammatic view of an impact matrix printer in accordance with the present invention along with a block diagram of the associated electrical circuit.

FIG. 1 shows a diagrammatic form of the printer of the present invention along with the associated electrical circuit. The printer includes a carriage 10 having a matrix print head 11 which, of course, would be associated with a ribbon, paper and a platen. Details of the carriage and how it is moved and more importantly how it will accommodate one or more ribbon cartridges of varying colors are described and claimed in copending application, Ser. No. 370,200 filed Apr. 21, 1982, entitled COLOR PRINTER, in the names of Richard Trezise, John Boldt and Keith Gnutzman. But, in general, carriage 10 is moved along its line of printing designated at 12 by a drive belt 13 which is driven by a motor 14. To sense both the velocity and linear position of carriage 10, there is an encoder 15 which provides two pulse trains separated in phase by 90° and also an index pulse. Such encoders are well known in the art as is their general use in indicating the position of a carriage on a printer. The output of encoder 15 is coupled to a velocity sensor unit 16 which, of course, also provides position information as indicated by the output designated ENC (encoder).

In general, by sensing the time between pulses from encoder 15, the actual velocity is provided on line 17, a 16 bit bus, in digital form. This is coupled to the microprocessor 18 and compared to a target velocity, indicated as input 19, to produce an error signal on line 21 which in turn drives motor controller 22 to control the speed of motor 14. The motor controller is, of course, DC and of the pulse width modulated type.

Figure 2:
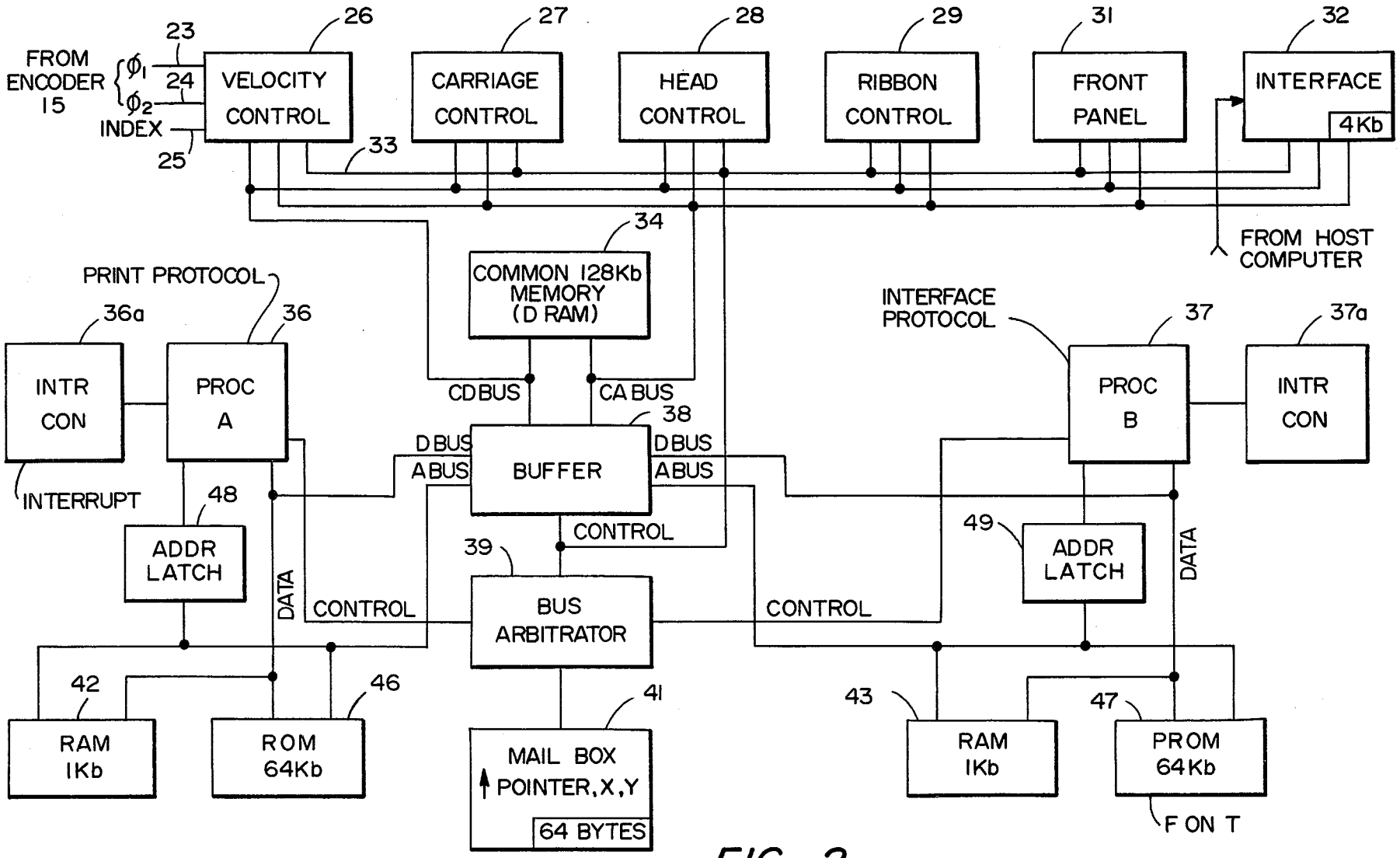
FIG. 2 is a block diagram of the system control electronics.

The system control electronics are illustrated in block diagram form in FIG. 2. FIG. 2, of course, in essence, is really microprocessor 18 and the target velocity input 19 is expressed in a more concrete format. As discussed in conjunction with FIG. 1, encoder 15 actually has two outputs of phase separated pulse trains on lines 23 and 24 and an index pulse on line 25. These are coupled to a velocity control function unit 26. And the other major control units are indicated in succession as carriage control 27 for manipulation of the various typical carriage operations such as shifting it away from the paper and shifting of cartridges, etc., as more fully explained in the above copending application. Head control unit 28 deals with, of course, the firing of the pins to form the matrix characters or graphics. Ribbon control unit 29 provides for the advancement of the ribbon. A front panel unit 31 provides for control inputs and displays. And an interface unit 32 communicates with the outside world such as the host computer for which the printer is printing the desired character or graphic's information.

Thus, typically, the host computer, as in other computer driven printers, would supply at least character data in the typical ASCII format. In block 32, is also illustrated the typical memory suitable for this application which is indicated as 4 kilobits.

All of the functional blocks 26 through 32 are interlinked on a common CD bus, a CA bus and linked among themselves on a bus 33. The buses in turn are linked to a 28 kilobit common dynamic random access memory 34. This is in effect the main memory of the system.

The system actually includes two separate microprocessing units. A processor A at 36 and a processor B at 37. Processor A controls the actual printing and is designated "print protocol," and processor B is for the "interface protocol;" that is, it handles the input from the interface unit 32. Each processor has its associated interrupt control unit 36*a* and 37*a* respectively. The processors are linked to the other functional blocks and the common memory 34 via the D or data bus via a buffer unit 38. Buffer unit 38 is controlled by a bus arbitrator 39 which gives priority in general to the print protocol processor 36. Connected to bus arbitrator 39 is a mailbox unit 41 (of 64 bytes memory capacity) which provides an X,Y pointer to data in common memory 34. Associated with processors A and B, of course, are scratch pad memories which are in the form of random access memories 42 and 43 respectively and also ROM and PROM memories 46 and 47.

ROM memory 46 of processor A contains the program under which the printer operates. ROM 46 and RAM 42 are connected to the D data bus and processor A. They also are connected to an A (address) bus which is connected to processor A through an address latch 48. Finally, there is a control line from processor A to the bus arbitrator 39. The same is true of processor B in that it includes the A address bus to its associated memories 43 and 47 and, in addition, an address latch 49. The ROM and PROM memories of the two processors, in addition to containing the programs for the operation of the various processors, ROM 46 contains instructions to construct a so-called speed map which is used to determine the target velocity 19 illustrated in FIG. 1. And, in the case of PROM unit 47 of the interface processor B, this contains character fonts which are the actual dot locations of characters or graphics to be printed. In other words, the font data in the PROM unit 47 serves to decode the ASCII character data from the host computer and place it in a format suitable for use by the printer. Lastly, it should be emphasized that in the FIG. 2 system control electronics diagram that while the functional blocks 26 through 32 may have partial existence as discrete digital circuitry they may also exist or be part of the programming of processor A and processor B.

Figure 3:
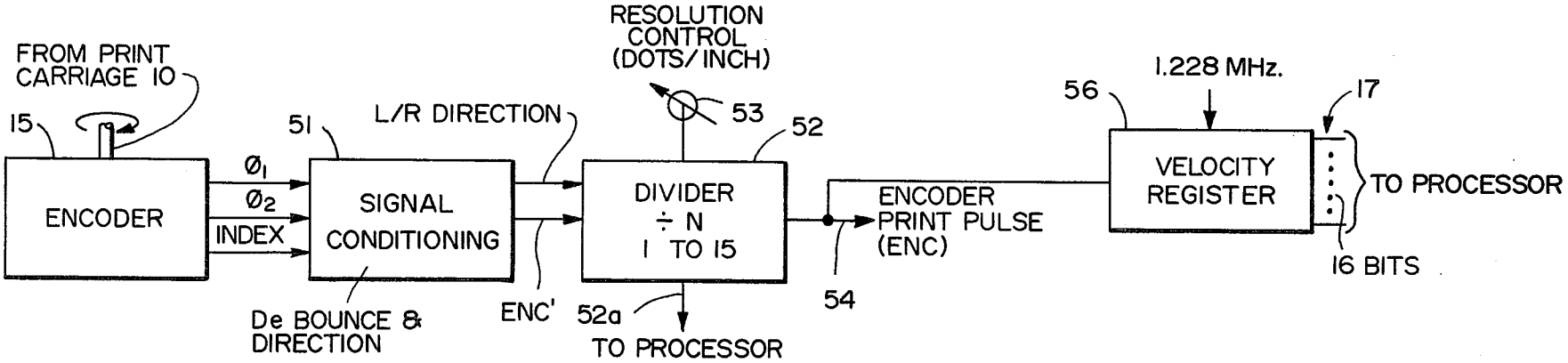
FIG. 3 is a block diagram of the velocity control portion of FIG. 2.

In the case of the velocity control unit 26, FIG. 3 shows a form of its digital logic. Encoder 15 is illustrated in block form which supplies the three designated inputs to a signal conditioning unit 51. This unit, which will be described in detail in conjunction with another figure, debounces the pulse trains or eliminates jitter which, for example, might occur on reversal of the carriage and utilizes the two phases for direction information. Thus, there is a left right, L/R, direction output and an encoder output designated ENC'. This encoder output is divided in a 1 to 15 divider unit 52 which by means of a resolution control input 53 (either manual or by computer) divides this encoder pulse train (which, of course, contains both position and velocity information) to provide on the output 54 the final encoder pulse train (ENC).

To emphasize what has been said before, the occurrence of an encoder pulse represents the actual physical position of the carriage along its line of printing; thus, the output 54 is used to coordinate the actuation of the print head. In addition, the spacing between successive encoder pulses represents the present velocity of the carriage. This spacing thus is sensed by the velocity register unit 56 which on a 16 bit bus line 17 (see FIG. 1) provides the actual velocity to the processor. What actually happens is that the velocity register acts as a counter, and the indicated 1.228 megahertz clock input provides the counting pulses to count up between ENC pulses.

Figure 4:
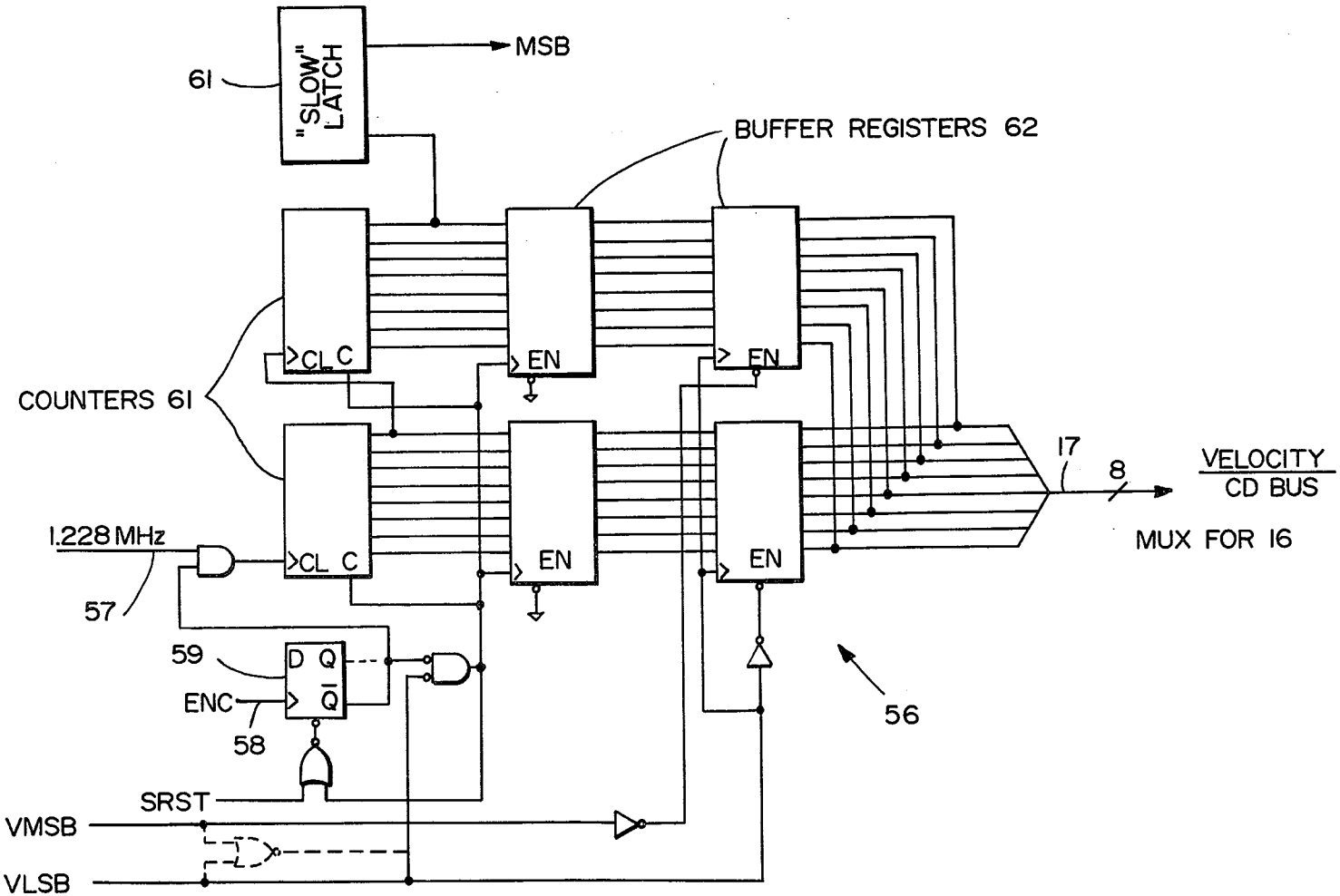
FIG. 4 is a detailed logic circuit of a portion of FIG. 3.

Details of the velocity register 56 are shown in FIG. 4. This velocity register is responsive to the encoder pulse as discussed in FIG. 3 and supplies on a 8 bit line bus 17 (which is actually multiplexed to provide a 16 bit bus) timing information to the processing unit. The velocity register is basically a frequency counter that is counting the number of system clock ticks (in this case, 1.228 megahertz indicated at input 57) between encoder pulses and latching this information. Thus, the current velocity is really the number of clock ticks between the last two encoder pulses received. And it should be noted that, although the term velocity is used, here actually for timing purposes the reciprocal of the velocity, to provide a period, is used. Referring to the details of the velocity register, the encoder pulse input is on line 58 which is the clock input to D-type flip-flop 59. The count is produced on the counter pair 61 which produces a 16 bit resolution. When the next encoder pulse is received, the contents of the counters are transferred to the four buffer registers 62 and the counters are reset. The output of each of the buffer registers 62 is, of course, the 8 bit bus; but this is multiplexed to provide for 16 bit resolution. In the case where the carriage is stopped or going very, very slow (for example, less than one inch per second), a latch 60 senses in essence the overflow or 17th bit which would otherwise cause the counter to go to zero and start counting up again which would be a false indication. But this bit is sensed by the slow latch 60. Thus, in essence, this provides a very slow indication which is used in the flow chart of FIG. 5.

This flow chart is a template of the typical operation of the motor control of the present invention. Starting at the top of the diagram, there is a one millisecond interrupt indicated at 63 which activates the routine. It interrupts its current task and goes to the velocity register (FIG. 4) and loads the current velocity as indicated by the "load velocity" step 64. This velocity is tested at 66 whether it is very, very slow, for example, less than one inch per second, by means of the latch 60; and if so, the speed is set to a very slow speed. This would occur, for example, during reversal. Actually, control of the motor during reversal is taken care of by another part of the logic. Assuming then that the speed is greater than one inch per second, then the velocity is valid.

Next, a target velocity is then subtracted from the actual velocity in step 67. The target velocity is taken from a precomputed speed map of the velocities in zones across the line of printing of the carriage for a particular line of printing. Such target velocity is computed and a speed map is formed which is actually stored in common memory 34 (see FIG. 2) by using the maximum velocity of the printer itself in conjunction with information that has been stored in advance regarding the two closest dots for that printing zone or line portion. In other words, the worse case condition for that particular zone.

Figure 6:
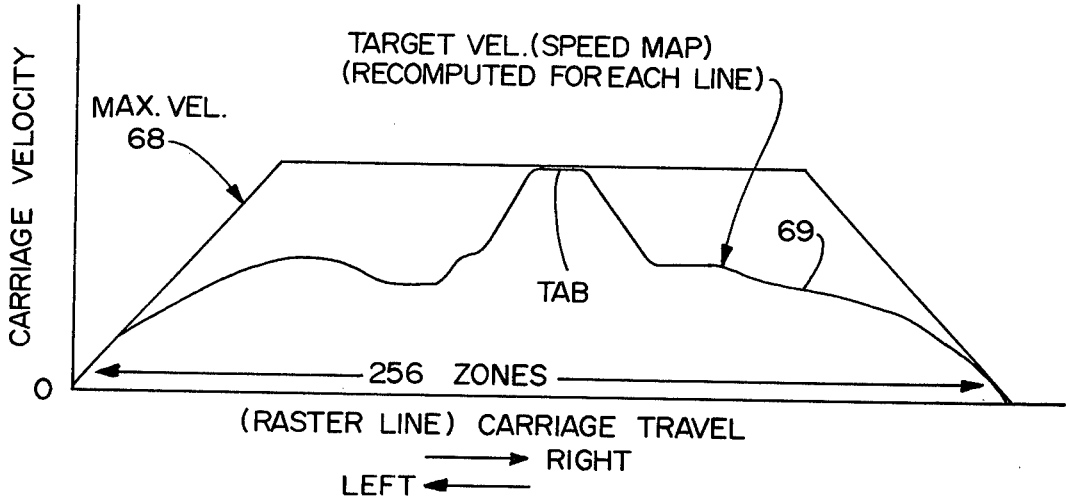
FIG. 6 is a graph useful in understanding FIG. 5.

Referring briefly to FIG. 6, a speed map for an entire line of printing is illusrated where the maximum velocity line 68 is the speed limit or the maximum velocity which is determined by the design of the mechanism. And line 69 is the actual computed velocity and, therefore, the target velocity. The target velocity is thus defined as the lesser of the two maps. And this varies from zone to zone. The speed maps are computed at separate times. The maximum velocity map 68 is computed at the design time, stored in ROM 46 (FIG. 2), and is the maximum design restriction for the mechanism. A target velocity map 69 is generated for this particular line of data by looking at the distance between the two closest dots in that zone of the traverse of the head. Then, there is computed what would be the recovery time required for those two dots which allows computation of the possible speed of printing based only on the head information.

A target velocity speed map is precomputed and recomputed for each line, divided into 256 zones, as illustrated by the curve 69. Note that one portion of the curve designated TAB (tabulate) is where, of course, no printing would occur; and therefore, the maximum velocity can be used.

Thus, it is apparent that this target velocity could not be constructed unless the raster had previously been stored. If such raster had not been stored, then perhaps for several lines the worse case condition would have to be taken into consideration and all printing would occur at this worse case condition providing a much lower overall throughput.

Figure 5:
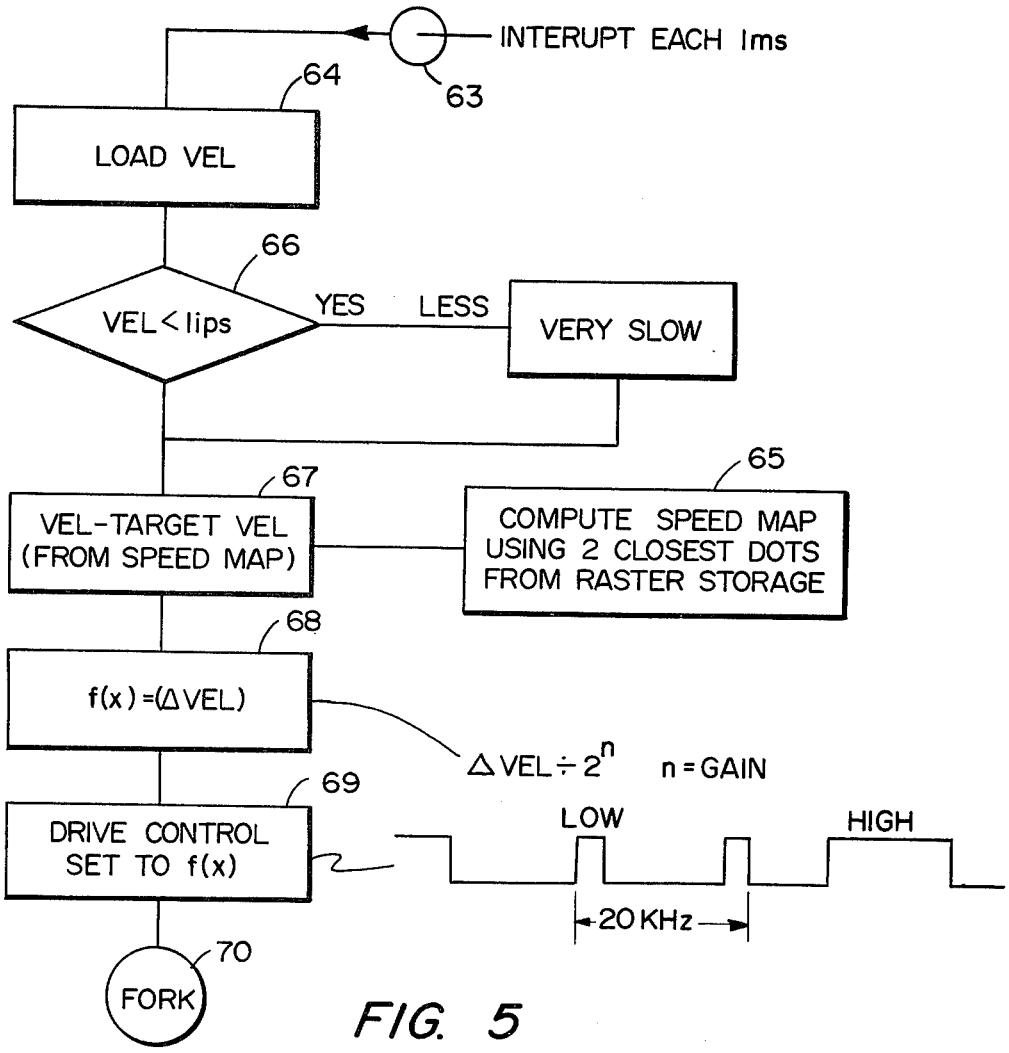
FIG. 5 is a motor control flow chart.
Figure 7:
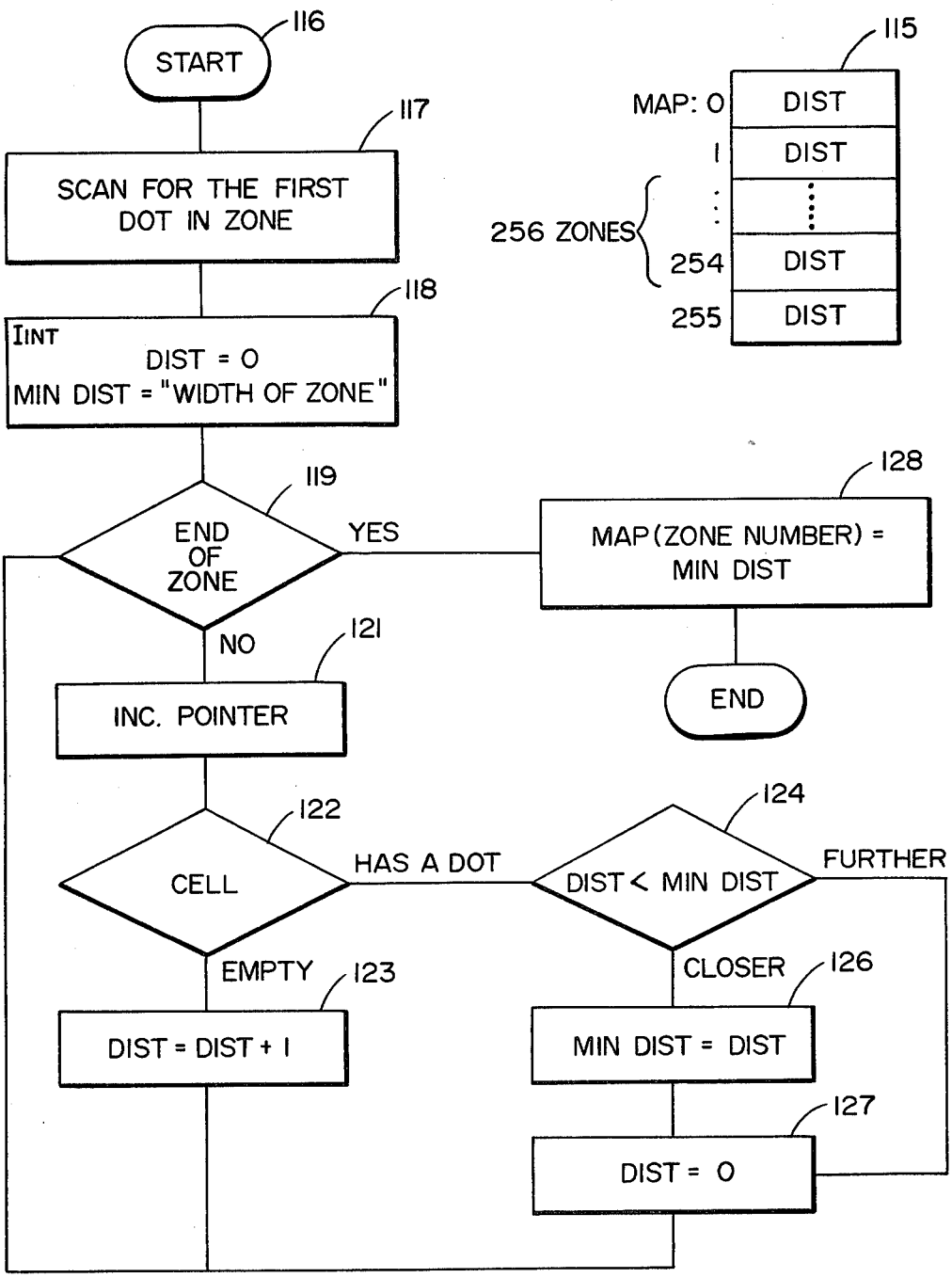
FIG. 7 is a flow chart used in computing a speed map.

Step 65 of FIG. 5 in which the speed map is computed using the two closest dots from raster storage is shown in greater detail in FIG. 7. The speed map itself is shown by block 115, and is divided into 256 zones. Each zone is designated "DIST" which is in effect the target velocity for that particular zone. Thus, referring to FIG. 6 momentarily, the target velocity map 69 is in effect the memory storage 115. After the program start in 116, in step 117 the buffer storage (see buffer 38 of FIG. 2) is scanned for the first dot in the zone. In step 118, the zone is initialized at a zero value and then a minimum distance, that is, "MIN DIST" is placed in the memory map 115 which is equivalent to the width of the zone. This would occur, of course, if there were no dots to be printed in that zone; and thus, the maximum velocity 68 would be utilized as shown in FIG. 6. In decision step 119, there is asked whether or not it is the end of the particular zone. If not, the pointer is incremented in step 121. Thereafter, in step 122, a decision is made as to whether or not the particular cell of that zone (a cell is considered to be related to each encoder pulse) is empty or has a dot. If it is empty, then DIST is incremented in step 123 to go to the next zone of the map and a return is made to step 119. If a normal situation occurs and the cell has a dot, then step 124 determines the distance of this dot from the first dot in the zone. And this distance is compared to "MIN DIST". If it is closer, then in step 126, MIN DIST is updated to the present DIST. In step 127, the DIST is initialized and return is made to step 119. On the other hand, in step 124, if the distance is further or greater, then a loop is made directly to 127.

Finally, after the entire zone is gone through, step 119 indicates end of zone; and in step 128, MIN DIST is stored for that particular zone in map 115 and the program for that zone is ended. Thereafter, all zones are completed to form the speed map for a "raster line" as illustrated in FIG. 6.

Referring back to the motor control flow chart of FIG. 5, the computation 67 gives a delta velocity. This is actually the error signal. Such error signal, as indicated in the step 68, is divided by 2 to the Nth power, where N is a gain function of the servo feedback loop. This value is set to a function of X, as shown in step 69 and the associated diagram, to provide the actual duty cycle of a pulse width modulated waveform at 20 kilohertz which is fed to the motor controller to provide the pulse width modulated control signal. At this point, there is a fork at 70 and the process is suspended to be reinacted the next millisecond.

In general, and still referring to the motor control flow chart, the motor after receiving a different pulse width modulated control signal begins to change its speed within five milliseconds. Thus, the one millisecond interrupt time is reasonable for good updating. In the case where a start is being made from a standstill and the carriage is ramping up to full velocity, the step 68 is not used but there is merely applied a full accelerating power to bring the carriage up to speed. And, thus, this is where the delta velocity approaches zero. Then, for ramping down, a set dynamic braking force is applied. More specifically, at the start of deceleration, the driving voltage is removed from the motor and it starts coasting down to zero and at a very slow speed it is brought to a stop such as at one inch per second. At a speed of five inches per second, for example, the last character is printed. The accuracy of the stop is important since the encoder is always keeping track of the exact physical location of the carriage and where the printed characters are.

Figure 8A:
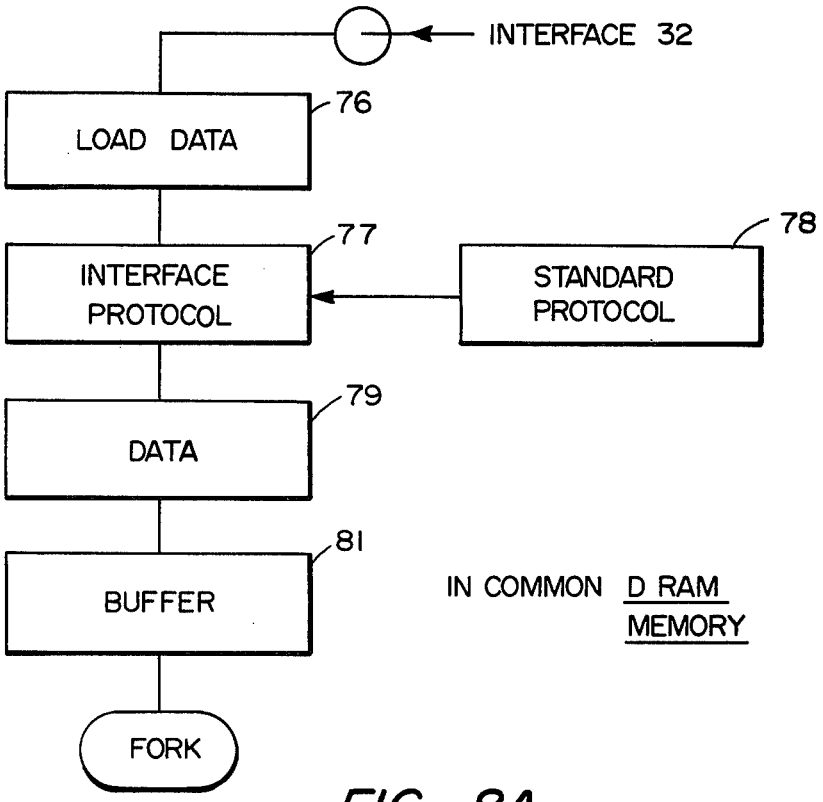
FIGS. 8A and 8B are flow charts useful in understanding the operation of FIG. 2.
Figure 8B:
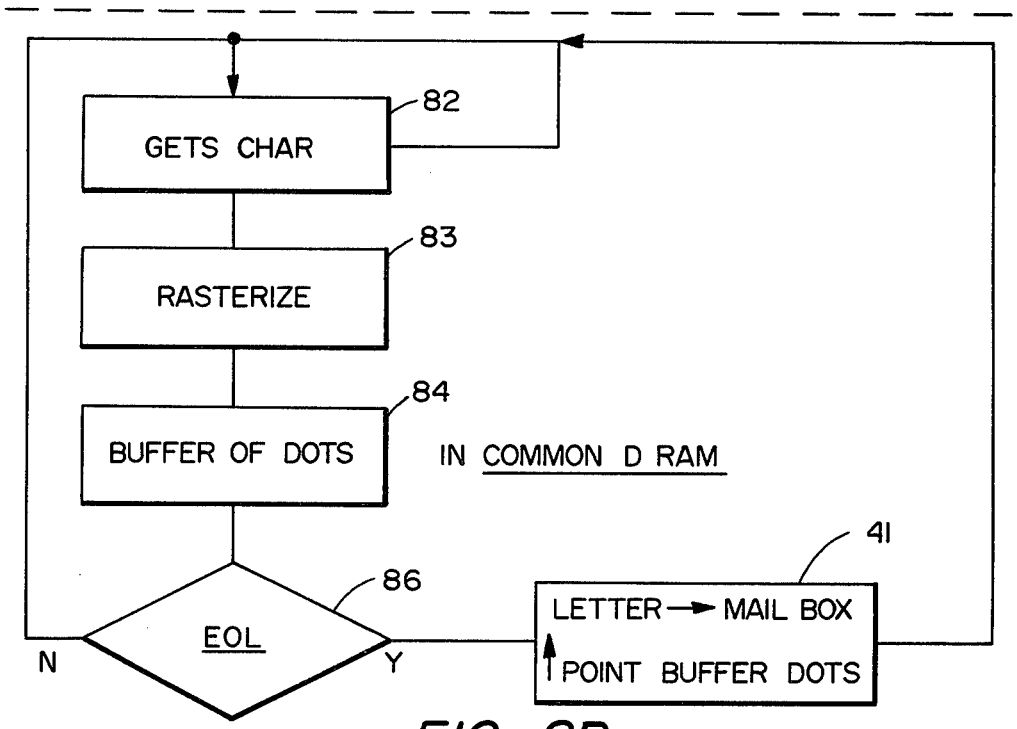

In computing target velocity from a speed map as discussed in FIG. 5 and shown in FIG. 6, it was stated the speed map is constructed using the two closest dots from raster storage. Such raster storage is actually in the dynamic memory 34 illustrated in FIG. 2. FIGS. 8A and 8B illustrate in greater detail the handling of the input data and its rasterization. In essence, it is termed "raster" since it may be compared to a video game where a line of the video raster is precomputed and prestored and then read out. The same function occurs in the printing process.

Specifically, each character that is to be printed is located in the font PROM 47 (FIG. 2) associated with processor B. In the font PROM for each character such as A or B, there is a list of bits of one's and zero's which when printed will construct that character. That is, these one's and zero's relate to the various pins on the matrix printer. The characters need not be standard A, B or C's, but they could be heart shapes or any pattern required to depict a symbol on the paper. Their size and shape is defined in the font which may be contained in either the PROM read only memory 47, ROM read only memory, or random access memory, that is, down loaded from the host computer. Thus, the host computers can define their own fonts "on the fly". It is also possible that the data itself is actually the dot description of what the user wishes to print; and thus, it can be directly placed into the buffer 38 and the common memory 34.

Thus, in forming the raster, there is a call for the data which is transferred from the font memory 47 to the buffer 38.

FIG. 8A relates to the interface protocol processor B (FIG. 2) and its relationship in turn with the interface unit 32 and the host computer. The interface input is indicated from the interface 32, and data is loaded as indicated at 76 from the customer's host computer. The interface unit which is connected to the host computer is normally a customized chip which takes into account the type of computer the host has and the purpose they are accomplishing and the interface protocol.

As each piece of data is sent from the host, it creates an interrupt to the B processor, loads the data from the interface, strips the interface protocol taking care of any requirement of the host protocol. This is done in steps 77 and 78. Step 78 indicates standard protocols which may be selected such as ACK-ETX, CONTROL S, CONTROL Q, RS 232 DTR, etc. And then the actual data in step 79, if it is valid, is passed through the buffer 38 in step 81 and stored in the common dynamic memory 34.

Next, FIG. 8B is at the program level. When it is initiated in step 82 by a "get character" search from the buffer, and if there are characters waiting and one becomes available, it rasterizes that character into dots in step 83 and transfers into the buffer of dots in the common dynamic RAM 34 as is indicated in step 84. When the entire line is stored, the end of line, EOL, is indicated at 86, a pointer is generated and put in the mailbox 41 (see FIG. 2 also) for the A processor pointing to this line of dots to be printed. Thus, this is the rasterized line of dots which corresponds to the next line to be printed which is used to determine target velocity in each zone by using the two closest dots from raster storage. And this is how the target velocity map of FIG. 6 is formed as discussed above.

With respect to color printing, as referred to previously in the copending application, there is a capability of having at least four tape cartridges and these might contain the primary colors or blendable colors. This information would actually be printed on the paper in four different passes. This means that when the information is rasterized, each color would be rasterized independently, and then each raster printed sequentially from the information derived from separate buffers.

Thus, in briefly comparing the rasterization concept of the present invention with prior matrix printers, the prior matrix printers would have the entire character stored in their font storage. And, rather than resterizing when the time came to print that character, they would take the entire character data out of the font and this would be printed. In the present invention, each printing position is represented by an encoder pulse or actually a dot cell and is handled discretely and separately by taking it out of the buffer one at a time. The advantage to using this rasterized buffer memory is for one example an infinite overstrike capability. For example, if a non-equal sign is being formed, first, and equal sign could be drawn from the font and then a slash formed from special information in a host computer. But this would not have to be done in two passes since the composite character could be prestored in the common memory by means of the rasterization process. Moroever, this rasterization process gives the machine great versatility when graphics and characters are being mixed. Normally, in prior matrix printers, there is a discrete graphic's mode and a discrete character mode and a special switch must be made between the two. In the present invention, in the common memory 34 where the line is prestored, any type of dot data can be intermixed.

Figure 9:
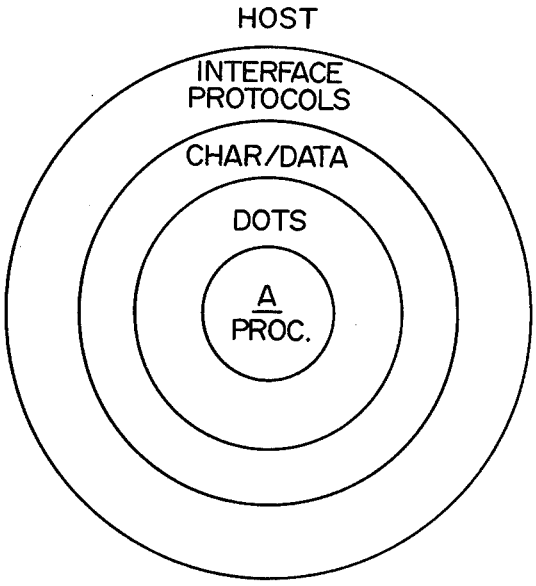
FIG. 9 is a conceptual diagram useful in understanding the invention.

Thus, FIG. 9 illustrates the overall concept of the invention. It could be visualized as a system like an onion with multiple cells. On the outside is the host computer communicating to the interface protocols which then communicates next to the characters and data which then is transmuted to dots which then communicates with the A processor which actually prints the dots on the paper.

Figure 10:
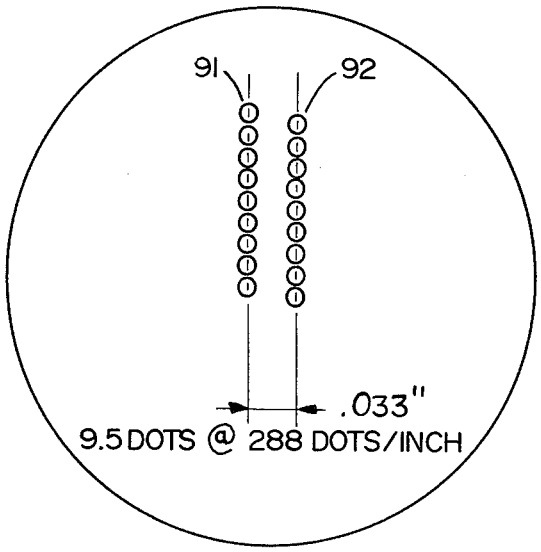
FIG. 10 is a plan view of a matrix print head.
Figure 11:
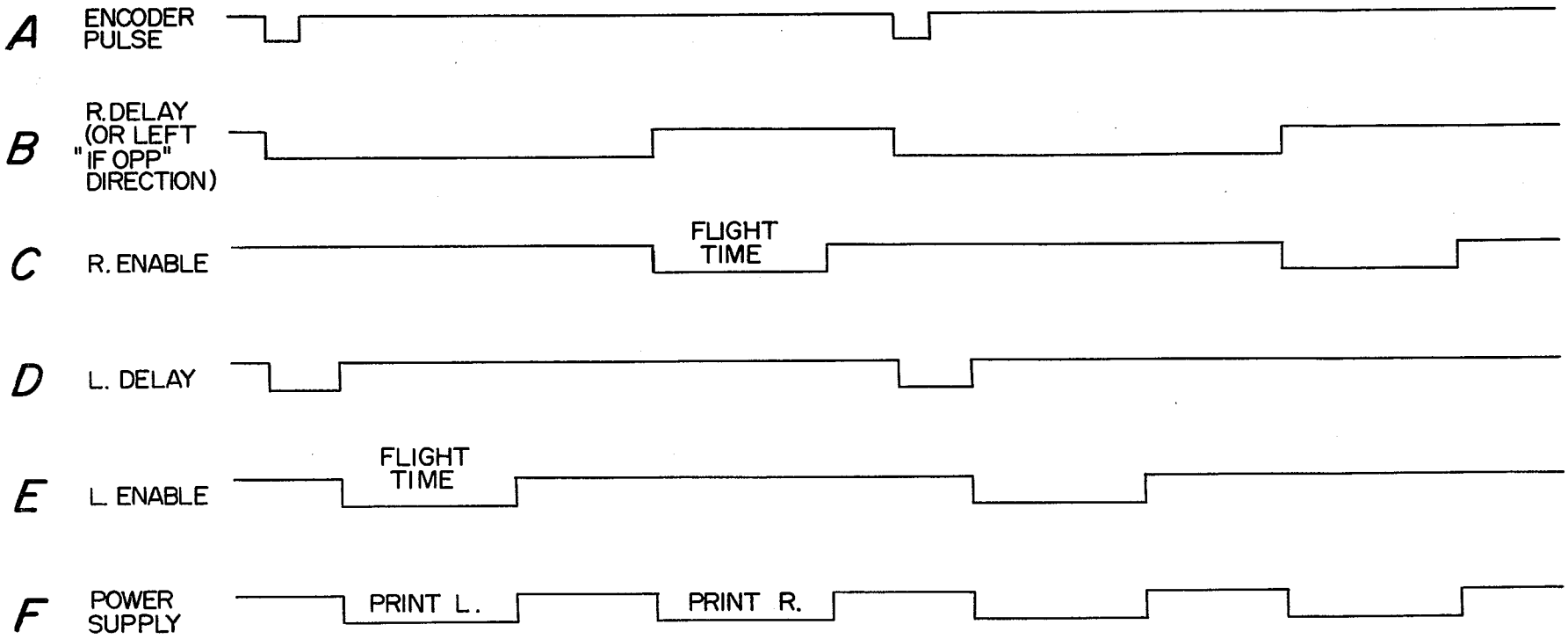
FIGS. 11A–11F are timing diagrams.

As thus far described, the system of the present invention has been seemingly concerned only with the control of the carriage velocity and not the actual firing of the various wires or pins of the print head. However, as will become clear below, the various conditions which have been set up are an integral part of the mode in which the print head operates. These conditions include the rasterization of characters and graphics to be printed for each line and the precomputing of a target velocity, which has already taken the print head recovery time into account. The print head itself is of a typical configuration as illustrated in FIG. 10 and includes a left bank 91 of 9 wires and a right bank 92 of 9 wires. These are sometimes referred to as the left head portion and the right head portion. For this particular head, the spacing of the banks is 0.033 inches. This is known as head width. These banks of wires can be fired independently in accordance with the present invention. The left and right head banks are physically separated by a gap or spacing which happens to correspond to 9.5 dots for a resolution of 288 dots per inch; head width multiplied by resolution provides the number of dots. Thus, the two banks must be fired using different timings. These timings are all related to the encoder pulse train shown in FIG. 11A.

Figure 12:
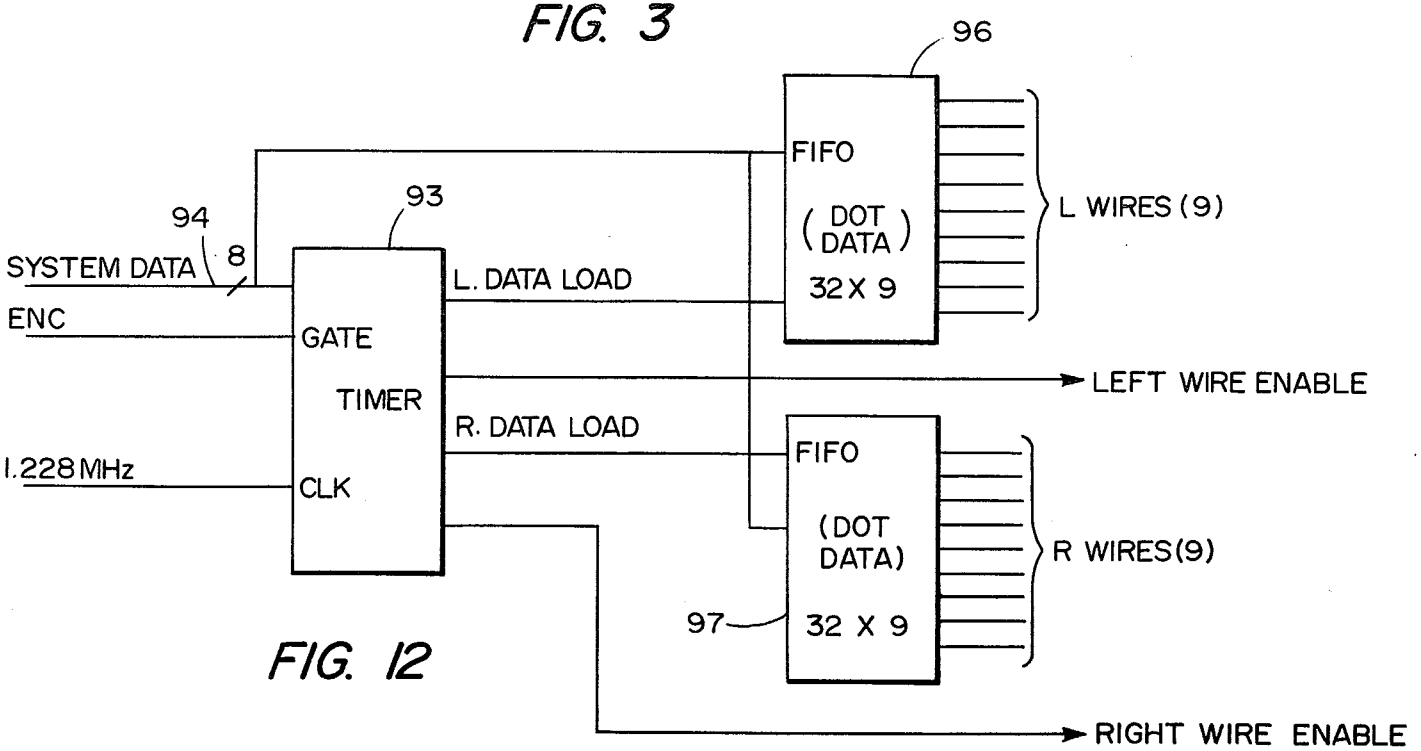
FIG. 12 is a head control logic circuit.

Such encoder pulse train is derived from the actual encoder pulse train generated by encoder 15 as illustrated in FIG. 1, and more specifically, is the encoder output line 54 of FIG. 3. For each encoder pulse, one dot or bank of dots from both the left and right banks of the printing head can be placed on the paper. Referring also to FIG. 12, for each encoder pulse, timer 93 is started for the left and right print head portions. Timer 93 is gated by the encoder pulses and clocked by the system clock. In addition, the system data from the rasterized line of data in memory 34 is actually coupled to the print wires on the left and right banks from a line 94. Timer 93 computes the delays illustrated in FIG.

Figure 13:
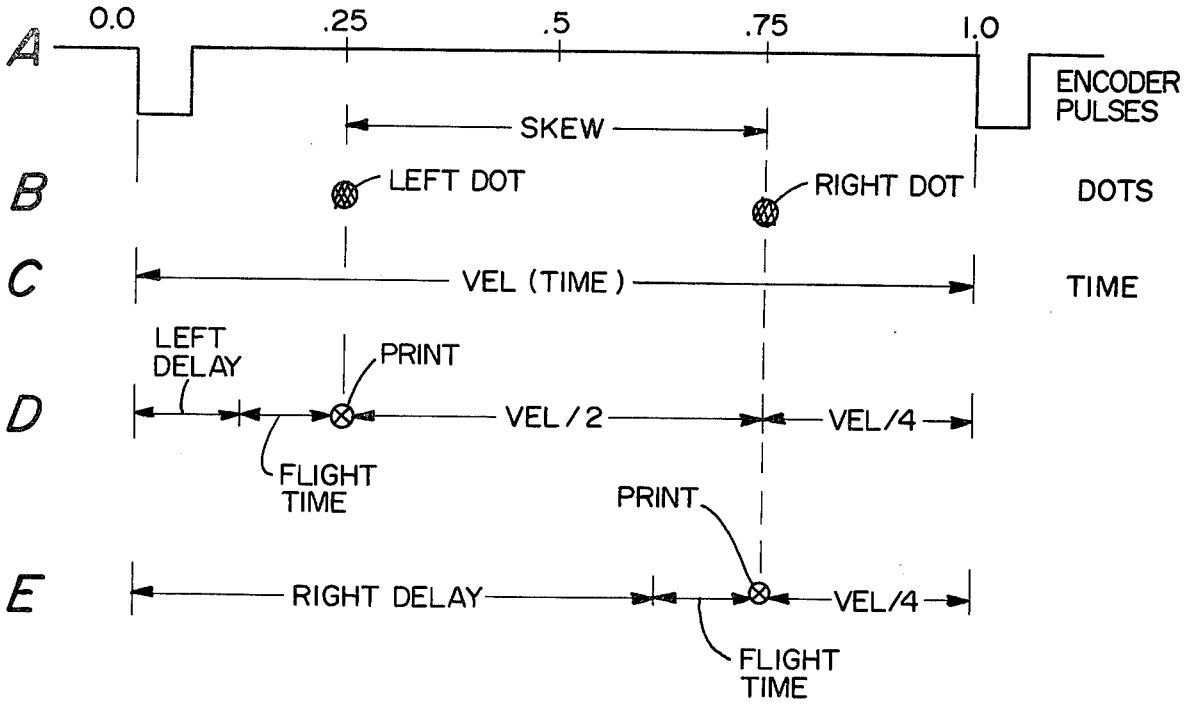
FIGS. 13A through 13E are timing diagrams related to the print head.

11B for the right delay and FIG. 11D for the left delay. Note that in FIG. 11B the delay is longer than the FIG. 11D since this is a compensation for the one-half dot difference with respect to the 9.5 dot difference between the left and right print head portions. Moreover, the delay as will be apparent from a discussion of FIG. 13 is a compensator for the fact that flight time, that is, the time from the actuation of an electromagnetic actuator of a wire or pin to the time of impact, is a constant; in other words, is determined by the physical limitations of the printing head and the electromagnetic actuating means itself. Thus, these two times are equal and shown in FIGS. 11C and 11E. The end of the flight time is actually the print time or the moment of impact. FIG. 11F illustrates how the power supply at a first time interval provides power for the left print bank, and at a second and different time interval power for the right bank. The reason for this is because of the one-half dot difference or skew between the two groups of pins or wires. Thus, by utilizing this skew, the power supply only requires sufficient power to supply one bank of pins at a time. And this skew will be effectively present for print heads of any head width.

Figure 12A:
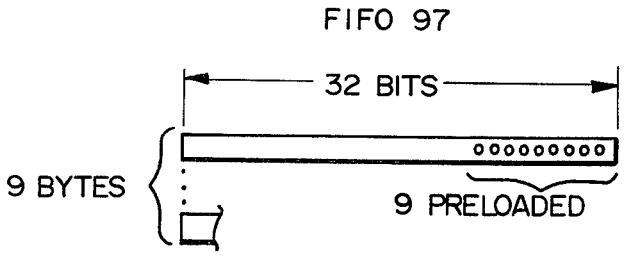
FIG. 12A illustrates the logic operation of FIG. 12.

The remaining circuitry of FIG. 12 includes FIFO (first-in first-out) memories 96 and 97 which receive system data (32 bytes of 9 bits each) to actuate on that basis the 9 wires or pins of the left and right print head banks. Most importantly, however, these FIFO memories take into account 9 dots of the 9.5 dot difference (that is, for a resolution of 288 dots per inch) by preloading either the right FIFO memory 97 in the case of one direction or the left FIFO memory 96 in the case of the opposite direction with 9 zeros for each line of printing. FIG. 12A illustrates such preloading which is, of course, accomplished for each of the 9 bytes of memory. This, in effect, is a delay which is transparent to the system as a whole. In view of the technique, it is quite simple for the reverse direction to load the FIFO memory 96. In addition, timer 93 as suggested in FIG. 11B must shift its delay from right to left for the opposite direction.

As was discussed above, timer 93 of FIG. 12 computes left and right delays which take into account the fractional dot difference in the left and right print head banks; and in addition, implicitly allows the power supplies as illustrated in FIG. 11F to supply only one bank of pins at a time. But, furthermore, this delay also allows for accurate printing to be accomplished during acceleration and deceleration since this delay takes into account the fact that the flight time is a constant which does not vary with the speed or velocity of the print head.

FIG. 13 is a graphical representation of how the left and right delay of FIGS. 11B and 11D are computed. FIG. 13A shows the encoder pulse train and is identical to FIG. 11A. However, the encoder pulse interval which is designated VEL in FIG. 13C is broken up into four portions. During acceleration and deceleration periods, this interval is, of course, continuously changing. However, from a practical standpoint, it is sufficient to assume when computing delay times that the previous interval, or for that matter, two or three previous intervals have substantially the same time; and this is what is done from a computing standpoint. But, depending on the final resolution and accuracy desired during acceleration and deceleration, it would be, or course, theoretically possible to have a processor forecast, based on the previous trend, the time for the next encoder pulse to be received and this time interval used.

In any case, referring in detail to FIG. 13, the one-half dot difference is illustrated in FIG. 13A as skew and the actual dots themselves at the time of the point of impact are shown in FIG. 13B as left dot and right dot. Assuming these dots have been printed at the particular times, because of the spacing or gap between the left and right print head banks, they would overlay one another; or from a practical standpoint, as illustrated in FIG. 10, the dots are actually shifted slightly in a vertical direction to fill in any gaps between the dots. FIG. 13C shows the VEL or time between the two encoder pulses, and this is actually the number of ticks of the system clock between the encoder pulses shown in FIG. 13A. FIGS. 13D and 13E show the computation of the left and right delays. This is actually the time between two encoder pulses as discussed above which has subtracted from it in the case of both print head banks the flight time; and in the case of the left bank, the velocity/2 plus velocity/4; and in the case of the right bank, the velocity/4. This, thus, provides the one-half dot difference or skew. And, with the subtraction of the fight time, the delays are thus computed by timer 93 (FIG. 12).

It is apparent from the timing diagrams of FIG. 13D and FIG. 13E that the delays will change in accordance with velocity of the print head and especially during acceleration and deceleration intervals. Moreover, the foregoing technique while taking this into account as well as the one-half dot difference takes into account the constant flight times which do not vary with the speed of the print head. The compensation provided by the delays is especially critical when printing is accomplished in both directions since the left and right delays are then reversed. Significant visual misalignment would otherwise be apparent in the printing especially where multi-pass printing is being accomplished.

The delay time must be adjusted for each resolution selected. Therefore, if, for example, a resolution of 366 dots per inch is chosen, by multiplying this resolution with the head width of 0.033 inches, a dot difference of 11.88 dots is computed. The integer portion of this is 11; and thus, in FIG. 12A, 11 zeros would be inserted. For ease of computation and accuracy desired, the fraction 0.75 is chosen. This is, in effect, the skew time. Thus, referring to FIG. 13, one bank of print wires would be fired at, for example, the 0.25 time as illustrated in FIG. 13A and the other at 1.0. The skew would still provide the proper sharing of the power supply since the minimum required condition is a 25 percent skew. For other resolutions and head widths, a suitable skew time can be chosen while still maintaining good registration.

When a different resolution is chosen, this is done by resolution control input 53 which has been indicated in FIG. 3. Line 52*a* from unit 52 symbolically indicates the notification of the processor that this change has been made. Of course, all of the foregoing can be accomplished by the software of the system.

The foregoing illustrates the sophisticated control available with the present invention in that the left and right print head banks can be effectively controlled independent of each other. At the same time, different head widths and resolutions are easily accommodated. Most importantly varying speeds, which will occur during acceleration and deceleration, are compensated for. This is, of course, of critical importance in a matrix printer of the present type where printing occurs during acceleration and deceleration intervals. Where, in the case of color printing, several ribbon cartridges are to be carried by the carriage, a machine or printer which is compact and inexpensive is still feasible.

Thus, in summary, with regard to the control of the print head, it is apparent that the print head is responsive to the actual position of the carriage and, of course, the head as determined by the encoder pulses. And, since these encoder pulses are completely responsive to the position of the carriage during acceleration and deceleration intervals, the print head is automatically actuated at the proper times. Thus, printing is enabled during both of these intervals.

Figure 14:
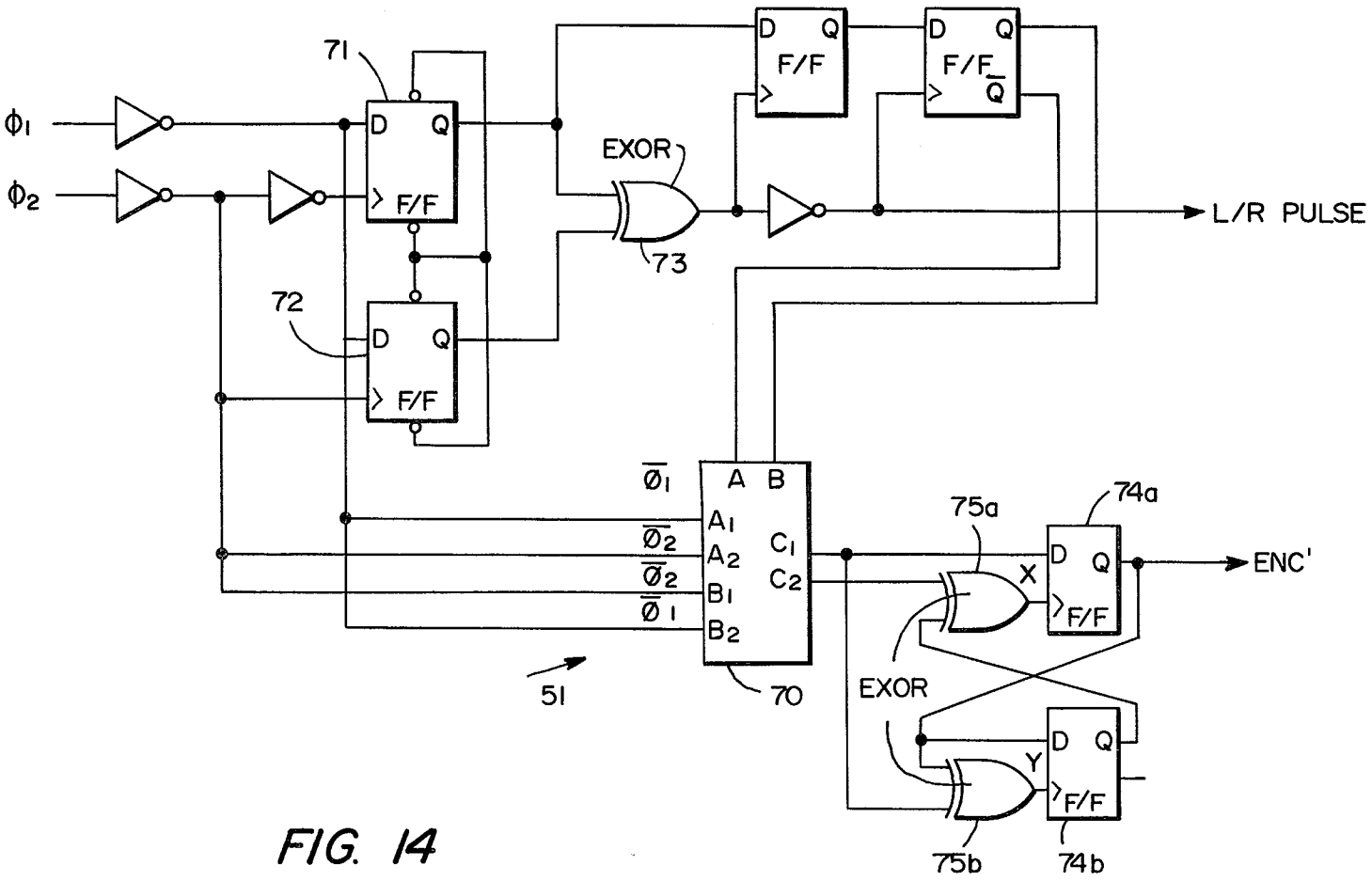
FIG. 14 shows the digital logic for the signal conditioning unit of FIG. 3.

FIG. 14 illustrates the functioning and logic of signal conditioning unit 51 of FIG. 3 in greater detail. The index output from encoder 15 is inverted and passed directly through the unit for use by the processors. The pulses of the $\phi_1$ and $\phi_2$ pulse trains are inverted and coupled to a two-to-one multiplexer unit 70. In addition, $\phi_1$ is coupled to the D inputs of D flip-flops 71 and 72 and $\phi_2$ directly clocks flip-flop 72, but its inverted form clocks flip-flop 71. The Q outputs of each flip-flop are coupled to exclusive OR gate 73 to provide a direction or L/R pulse; and in addition, provide the A and B enable inputs to the two-to-one multiplexer 70.

The two outputs, $C_1$ and $C_2$, of multiplexer 70 drive D type flip-flops 74*a*, 74*b* and exclusive OR gates 75*a*, 75*b* as indicated. The outputs of the flip-flops are cross-coupled back to the exclusive OR gates. Also the Q output of flip-flop 74*a* is the ENC′ pulse which, as indicated in FIG. 3, is the debounced pulse. The output of exclusive OR gate 75*a* is indicated as X and gate of 75*b* as Y.

Figure 15:
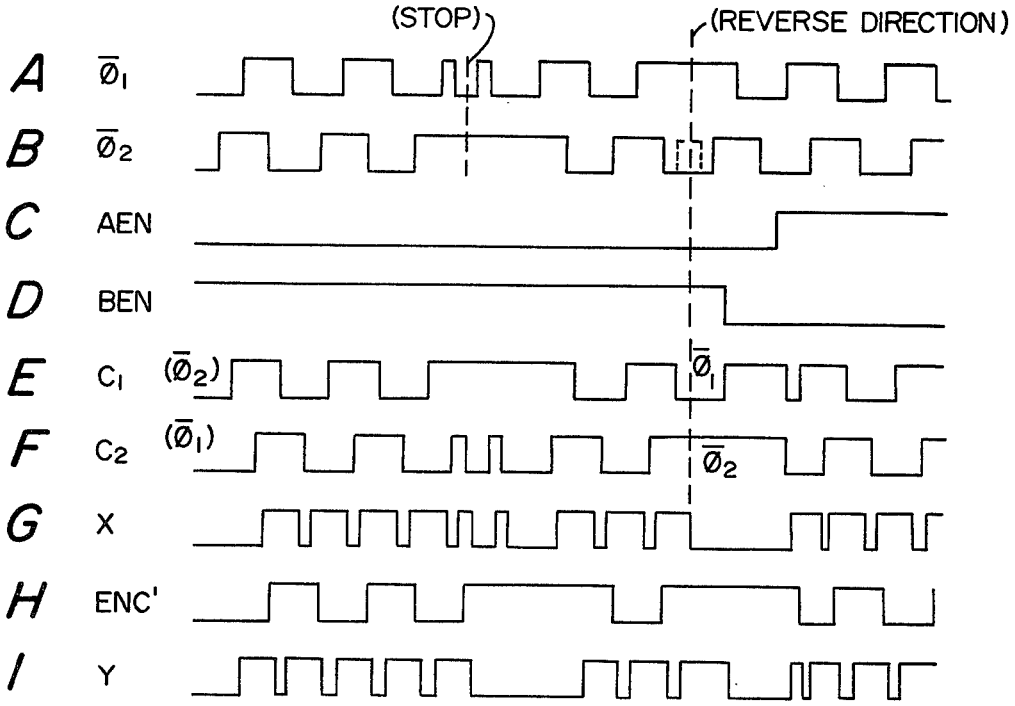
FIGS. 15A–15I are timing diagrams for FIG. 14.

FIGS. 15A through 15I are timing diagrams showing various pulse trains which are present in FIG. 14; viz., FIGS. 15A and 15B are the inverted $\phi_1$ and $\phi_2$ input pulses, FIGS. 15C and 15D the A enable and B enable, and most importantly FIGS. 15E and 15F show the $C_1$ and $C_2$ outputs of multiplexer 70. Initially, $C_1$ and $C_2$ are $\phi_2$ and $\phi_1$ respectively. Upon reversal, as shown by the dashed line designated "Reverse Direction," the pulse trains are reversed.

The two situations where debouncing is required or jitter may occur are at the indicated positions of "stop" where in FIG. 15A extra pulses may occur and "reverse direction" where as indicated in FIG. 15B extra pulses may occur.

Very simply speaking, the anti-jitter or debounce system is essentially embodied in the exclusive OR gates and D type flip-flops 74 and 75. The exclusive OR gates are used to provide X and Y outputs as shown in FIGS. 15G and 15I which are sensitive to the rising edges of the $C_1$ and $C_2$ pulse trains. In addition, to avoid jitter on the leading or trailing edges of the $C_1$ and $C_2$ pulse trains (see FIG. 15E), clocking is made to occur in the center of the pulses. Thus, FIG. 15H illustrates this effect where ENC′ is, for example, in the first part of the timing diagram, shifted 90° from $\phi_2$.

Lastly, as illustrated in FIG. 15H, the final output pulse train has eliminated the effects of the bounce due to the "stop" and the "reverse direction".

Figure 16A:
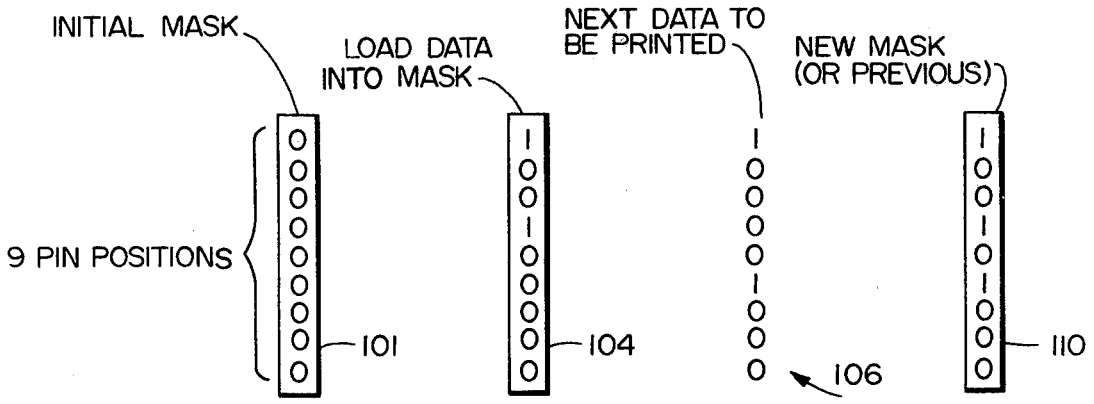
FIG. 16A illustrates the ribbon advance process.
Figure 16B:
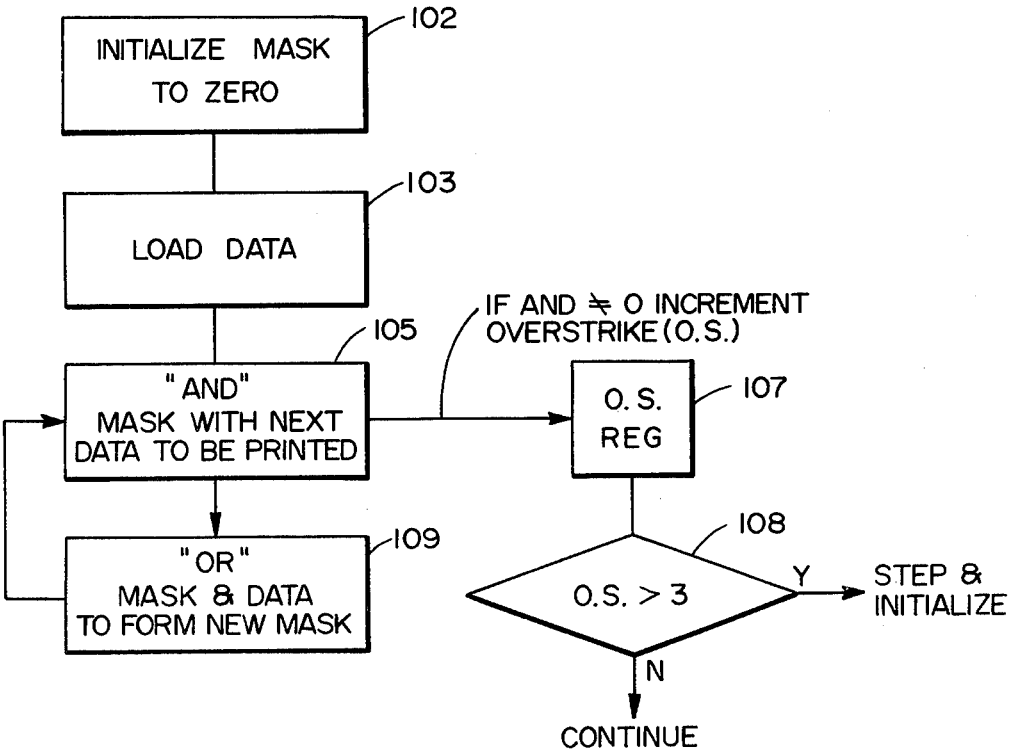
FIG. 16B is a flow chart for FIG. 16A.

Lastly, FIGS. 16A and 16B relate to how the ribbon is advanced. This is especially useful in conserving ribbon where several colors are used. In comparison, in prior printers, there was a set increment and the amount of printing was not taken into account.

As indicated in FIG. 16A, there is a mask or template of memory 101 which contains the 9 pin positions. As discussed previously, the left and right print head portions operate independently; and thus, this is done for both. Initially, mask 101 is all zeroes. This relates to the step 102 of FIG. 16B "initialize mask to zero." Next, in step 103, the data which is to be printed is loaded into this mask (see mask 104). Assuming this data is effectively printed in step 105, theoretically that mask is ANDED with the next data to be printed indicated at 106. Here again each bit to be printed, which is indicated by a one, represents one pin in that head which will be actuated. If there are any dots in the old template that correspond to the dots in the next data to be printed, then those dots would correspond with previously depleted places in the ribbon. If so, the number of overstrikes for this ribbon position is incremented. This is shown by the overstrike (O.S.) register 107. If the number of overstrikes recorded for any one of the 9 pin positions is greater than 3 as indicated at step 108, then the "yes" branch is followed, the ribbon is advanced or stepped to a new unused portion, and the mask is initialized as shown in FIGS. 16A and 16B at 101, step 102. If no, then the process is continued. Referring to step 109, a mask as shown at 110 is formed by ORing the present mask data with the next data to be printed. This new mask is then used in step 105 for the ANDing procdure to increment the overstrike register.

The tendency of the system is, of course, to overcompensate for multiple strikes of pins on a single position by erroring toward too many overstrikes rather than less which is an acceptable error. In other words, there is a possibility that in the next character to be printed, the overstruck pin position might not be needed. However, this would complicate the logic.

Thus, an improved servo system for the carriage of a matrix impact printer has been provided.

What is claimed:

1. A servo control system for the carriage of a matrix impact printer where the carriage in addition to carrying a print head carries a plurality of ribbon cartridges, said system comprising:

a motor controller for driving said carriage; means for sensing the actual velocity and position of said carriage;

means for determining a target velocity including means, for storing in advance of printing, binary data representing a line or raster of printing, said binary data also being related to predetermined pins of said matrix, and means for computing the distance along the line of printing for the two closest dots to be printed by said pins with respect to a predetermined zone portion of said line, and utilizing said distance to determine said target velocity for said zone;

means for comparing said actual and target velocities to provide an error signal which drives said motor controller for said carriage.

2. A servo control system as in claim 1 including means for utilizing said raster data to determine the number of overstrikes on a printing ribbon for advancing such ribbon.

3. A system as in claim 1 where said actual and target velocities are expressed in a digital binary format.

* * * * *